US007330645B2

(12) United States Patent
Kwon

(10) Patent No.: US 7,330,645 B2
(45) Date of Patent: Feb. 12, 2008

(54) INSTANT WATER HEATING APPARATUS FOR CLEANING MACHINE

(75) Inventor: Sun-Duc Kwon, Cheonan-si (KR)

(73) Assignee: Novita Co., Ltd. (KR)

( * ) Notice: Subject to any disclaimer, the term of this patent is extended or adjusted under 35 U.S.C. 154(b) by 0 days.

(21) Appl. No.: 11/473,711

(22) Filed: Jun. 23, 2006

(65) Prior Publication Data

US 2007/0166017 A1 Jul. 19, 2007

(30) Foreign Application Priority Data

Jan. 2, 2006 (KR) ..... 10-2006-0000232
Mar. 16, 2006 (KR) ..... 10-2006-0024226

(51) Int. Cl.
*F24H 1/20* (2006.01)

(52) U.S. Cl. ..... 392/456; 392/479

(58) Field of Classification Search ..... None
See application file for complete search history.

(56) References Cited

U.S. PATENT DOCUMENTS 4,731,072 A * 3/1988 Aid ..... 604/408
4,762,980 A * 8/1988 Insley ..... 392/494
5,381,510 A * 1/1995 Ford et al. ..... 392/470
5,388,180 A * 2/1995 Bayles ..... 392/484
5,729,653 A * 3/1998 Magliochetti et al. ..... 392/485
6,477,324 B1 * 11/2002 Sun ..... 392/482
6,912,357 B2 * 6/2005 Bissonnette et al. ..... 392/465
7,039,305 B1 * 5/2006 Chen ..... 392/490
2002/0181948 A1 * 12/2002 Akahane ..... 392/470

FOREIGN PATENT DOCUMENTS

KR 10-0484344 1/2001
KR 2003-0063065 7/2003

* cited by examiner

*Primary Examiner*—Thor S. Campbell
(74) *Attorney, Agent, or Firm*—Cantor Colburn LLP

(57) ABSTRACT

Provided is an instant water heating apparatus for a cleaning machine capable of instantaneously heating fluid passing through a flow path and preventing the temperature of the heated fluid from creating a laminar flow. The instant water heating apparatus includes a housing having a water inlet port, a water outlet port, and a flow path formed between the water inlet port and the water outlet port; a heat exchange part having a heating part for exchanging heat with fluid supplied through the water inlet port and guiding the fluid to the water outlet port; and a mixing part for uniformly mixing the laminar fluid when the fluid heat-exchanged in the heat exchange part is guided to the water outlet port.

23 Claims, 7 Drawing Sheets

INSTANT WATER HEATING APPARATUS FOR CLEANING MACHINE

CROSS-REFERENCE TO RELATED APPLICATION

This application claims the benefit of Korean Patent Application Nos. 2006-0000232, filed Jan. 2, 2006 and 2006-0024226, filed Mar. 16, 2006 the disclosure of which is hereby incorporated herein by reference in its entirety.

BACKGROUND OF THE INVENTION

1. Field of the Invention

The present invention relates to an instant water heating apparatus for a cleaning machine, and more particularly, to an instant water heating apparatus for a cleaning machine capable of instantaneously heating fluid passing through a flow path and preventing the heated fluid from creating a laminar flow.

2. Description of the Related Art

Generally, a water heating apparatus functions to heat fluid, mainly water, to a predetermined temperature. Such a water heating apparatus may be installed in a water heater, a boiler, a hot water cleaning machine, an automatic vending machine, and so on, in which hot water is used.

Here, the hot water cleaning machine mainly adopts an instant water heating apparatus for instantly heating water to immediately use the hot water. Such an instant water heating apparatus is disclosed in Korean Patent Registration No. 484344, entitled "Bidet". In addition, the instant water heating apparatus includes a water inlet port, a water outlet port, and a heater for heating liquid supplied to the water inlet port to a predetermined temperature.

While the instant water heating apparatus is provided with the heater installed on a single zigzag path to increase heat exchange efficiency, since the flowing fluid is instantly heated, the temperature of the fluid is divided into a region in contact with the heater (a hot water region) and a region not in contact with the heater (a cold water region), thereby creating a laminar flow.

Then, the water is supplied through the water outlet port with the laminar flow. Therefore, when the laminar fluid performs a cleaning operation, the hot water and the cold water simultaneously contact the skin, thereby giving a user an unpleasant feeling due to a temperature difference.

In addition, when a temperature sensor adjacent to the water outlet port of the instant water heating apparatus detects the cold water region of the laminar fluid, a heater heats the fluid on the basis of the temperature of the cold water region, and therefore, the hot water region of the laminar fluid is heated to a higher temperature which may burn the user.

On the other hand, when the temperature sensor detects the hot water region and heats the laminar fluid on the basis of the hot water region, the cold water region may be supplied at an even lower temperature which can shock the user.

In order to solve these problems, Korean Patent No. 420081, entitled "Instant Water Heating Apparatus for Bidet" discloses an apparatus including a plate having an outlet port formed at a heat exchange part to prevent laminar flow. However, since the fluid is in contact with a heating means until it arrives at the outlet port, laminar fluid is supplied to the water heating apparatus through the outlet port, without solving the problems of laminar flow.

SUMMARY OF THE INVENTION

In order to solve the foregoing and/or other problems, it is an objective of the present invention to provide an instant water heating apparatus capable of applying a plate heater to a fluid supply passage in a cleaning machine to instantly heat fluid, thereby maximizing thermal efficiency.

It is another objective of the present invention to provide an instant water heating apparatus capable of preventing fluid, which is heat-exchanged and supplied, from being supplied in a laminar flow divided into a hot water region and a cold water region.

In one aspect, an instant water heating apparatus for a cleaning machine includes: a housing having a water inlet port, a water outlet port, and a flow path formed between the water inlet port and the water outlet port; a heat exchange part having a heating part for exchanging heat with fluid supplied through the water inlet port and guiding the fluid to the water outlet port; and a mixing part for uniformly mixing the laminar fluid when the fluid heat-exchanged in the heat exchange part is guided to the water outlet port.

The heat exchange part may be installed at the housing, and provided with partition walls having a through-hole at its one side so that the flow path has a zigzag shape.

The mixing part may include a water level sensor for detecting the level of the heat-exchanged fluid, and a water outlet sensor for detecting the temperature of the mixed fluid, wherein the water outlet sensor is disposed adjacent to the water outlet port.

The mixing part may further include an introduction port for introducing the fluid heat-exchanged in the heater, and the introduction port may be formed larger than the water outlet port so that the mixing part generates countercurrent to mix the heat-exchanged fluid.

The introduction port may be disposed indirectly across from the water outlet port to increase mixing efficiency at the mixing part.

The heater may include a fuse for preventing the heater from being overheated, and the fuse may be directly installed at heat generating bodies of the heater.

The heater may include a bimetal for uniformly controlling the temperature of the heat-exchanged fluid, and the bimetal may be installed adjacent to the water outlet port of the housing.

While safety devices such as the fuse and bimetal may be fastened using a separate member by screws, in order to more simply and stably attach the fuse and bimetal, a high temperature silicon-based adhesive agent having a high thermal conductivity may be used to obtain properties such as insulation, thermal conductivity, attach ability, and so on.

The housing may include a water inlet sensor for detecting the temperature of the fluid entered through the water inlet port to adjust a calorific value of the heater, and the water inlet sensor may be installed at the water inlet port.

The housing may further include a water outlet sensor for calculating the temperature detected by the water inlet sensor to obtain a correction value, and correcting the calorific value using the correction value, and the water outlet sensor may be installed at the mixing part.

The heater may be a plate heater, the plate heater has a plurality of ruthenium-based heat generating bodies for generating heat by applying current, which are plastically deformed at a high temperature to be attached to one surface of a heat transfer material at predetermined intervals, each of the heat generating bodies is connected to lead wires to supply current, and a conductor may be installed at the heat generating bodies to connect both ends of each of the heat generating bodies so that current can be simultaneously supplied from the lead wires.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE INVENTION

Embodiments of the invention will now be described in detail with reference to the accompanying drawings. Some of the terminology and names of components used throughout the following description have been chosen for their functional descriptiveness, however should not be construed as limiting the scope of the invention.

Figure 1:
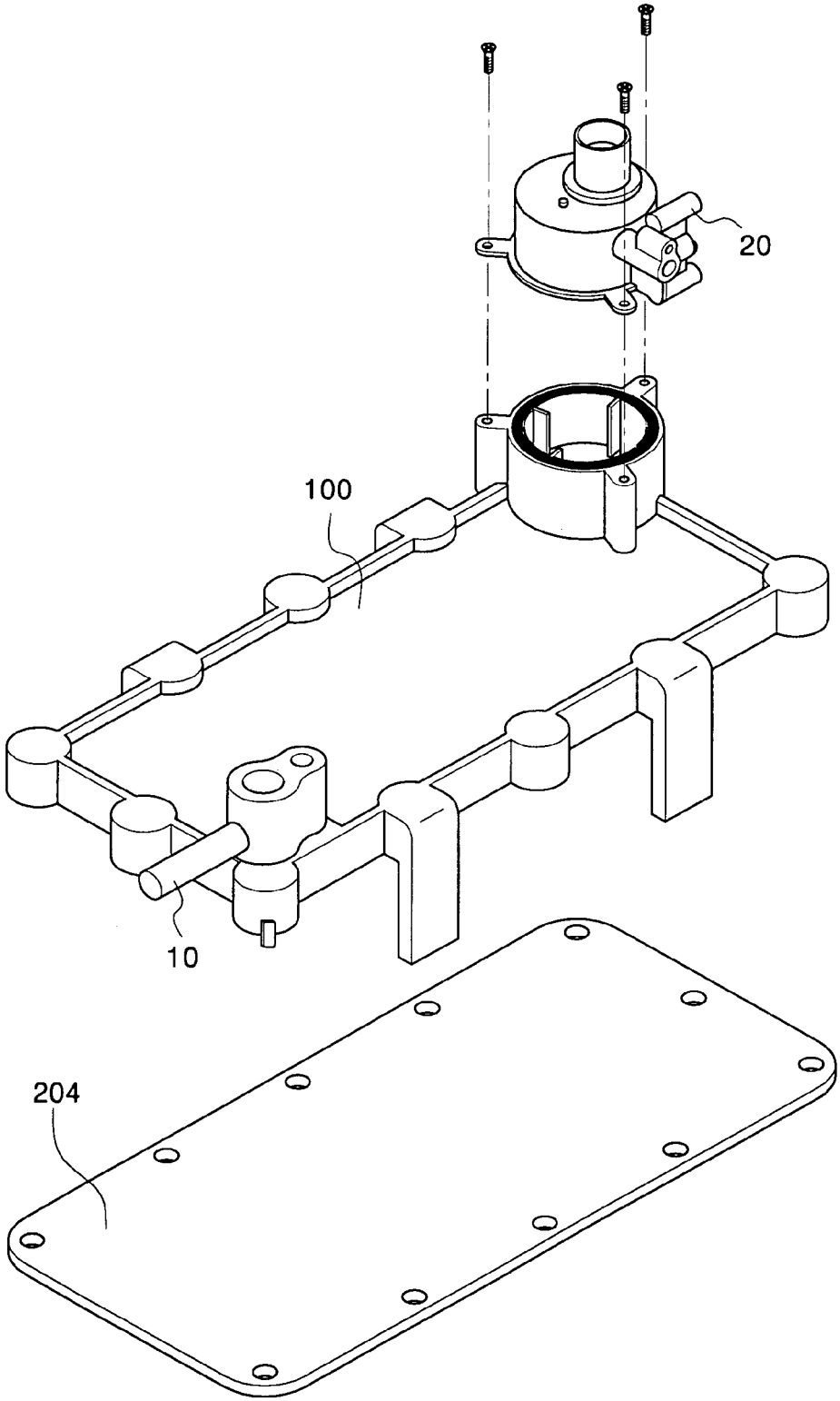
FIG. 1 is an exploded perspective view of an instant water heating apparatus for a cleaning machine in accordance with an exemplary embodiment of the present invention.
Figure 2:
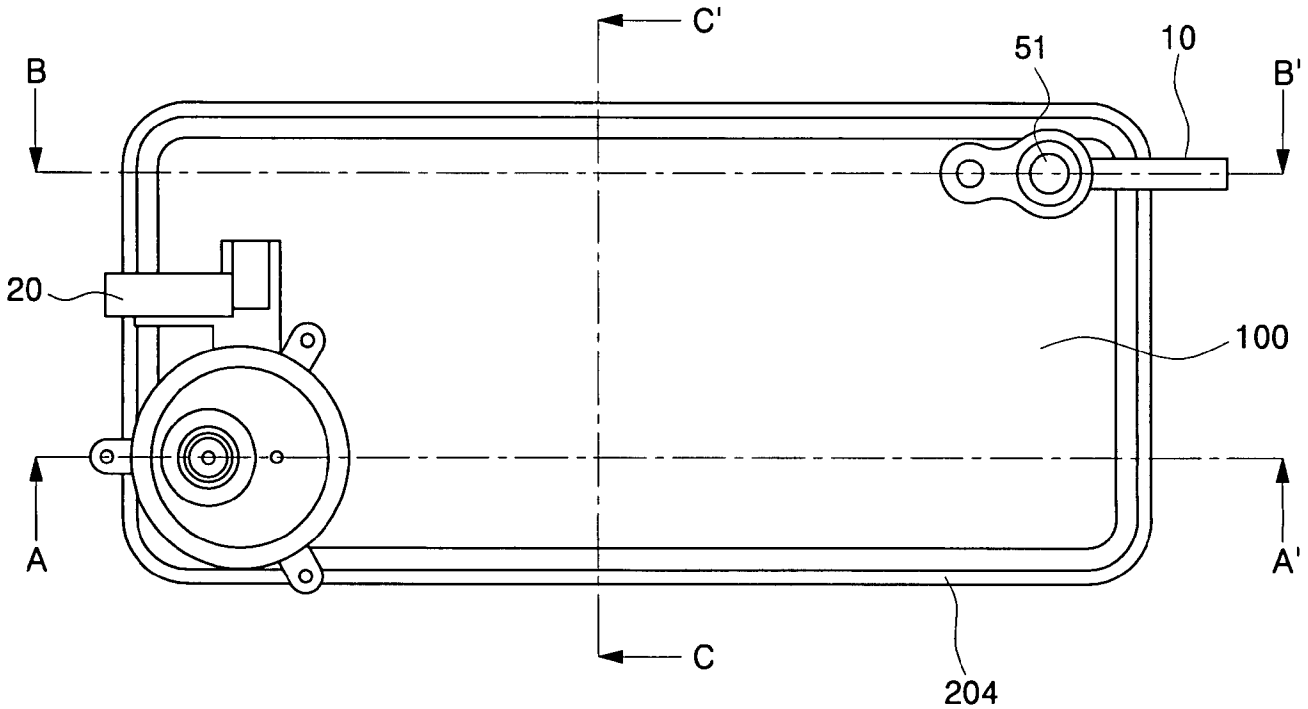
FIG. 2 is a plan view of the instant water heating apparatus for a cleaning machine in accordance with the exemplary embodiment of the present invention.
Figure 3:
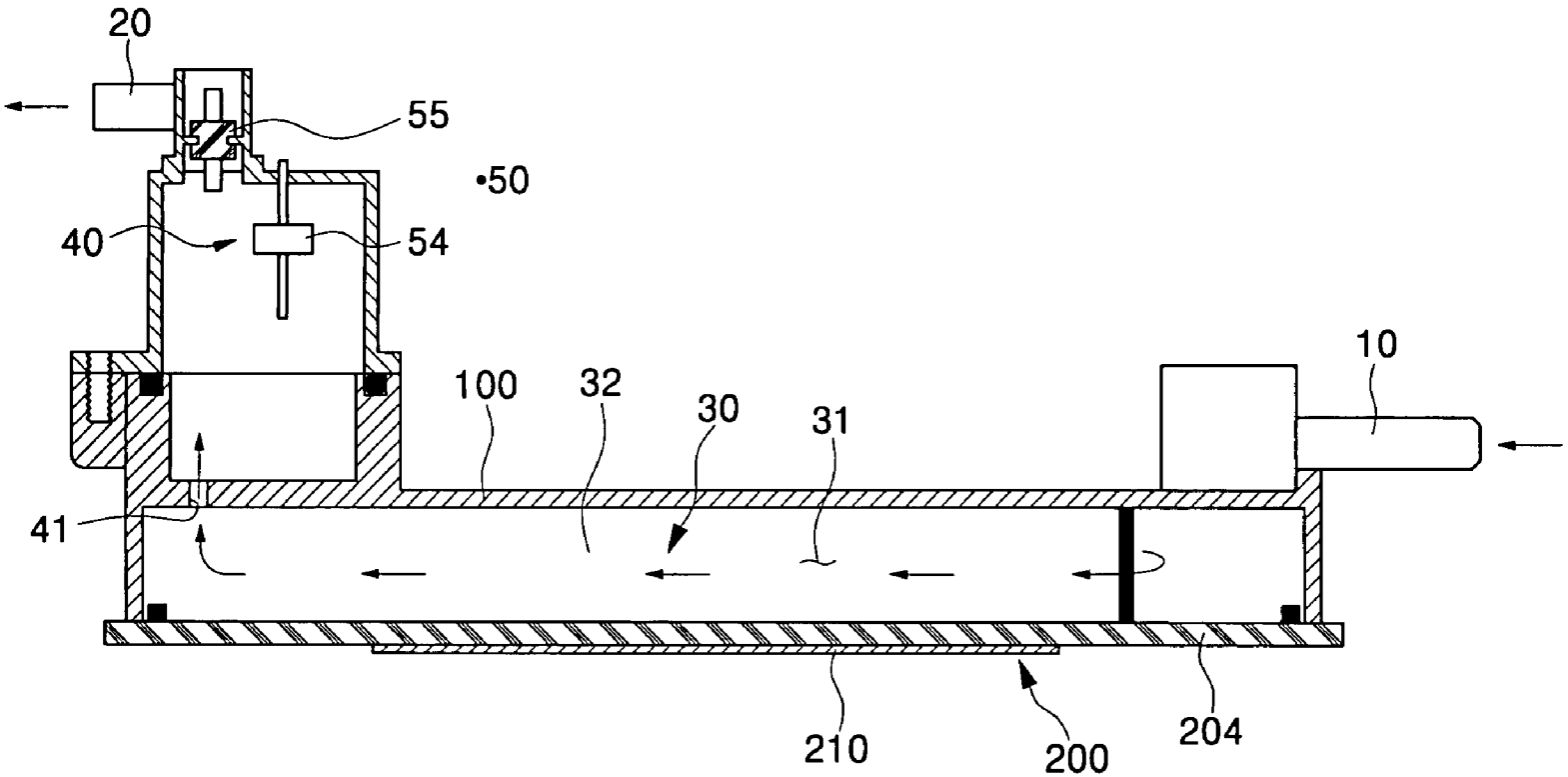
FIG. 3 is a cross-sectional view taken along line A-A' in FIG. 2.
Figure 4:
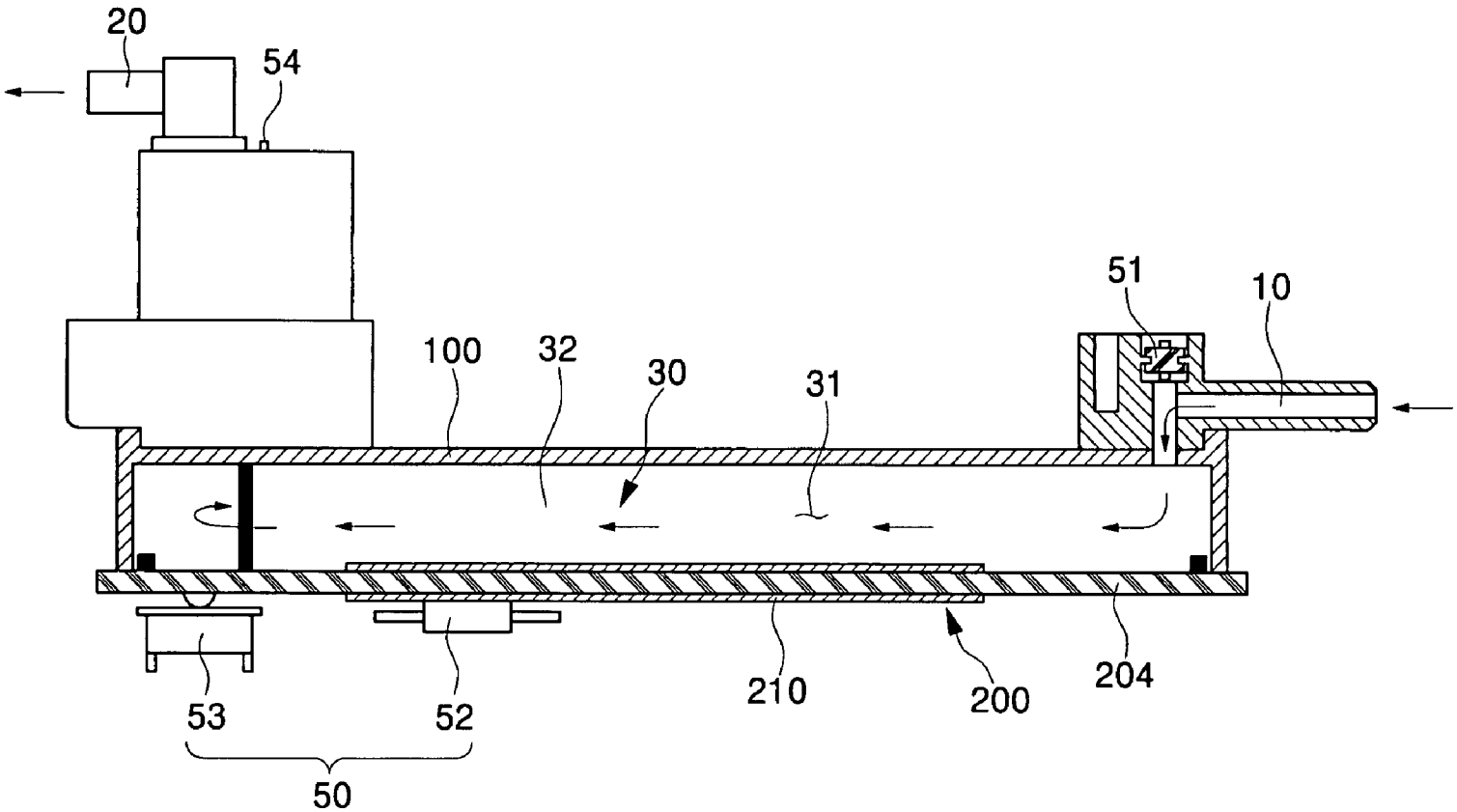
FIG. 4 is a cross-sectional view taken along line B-B' in FIG. 2.
Figure 5:
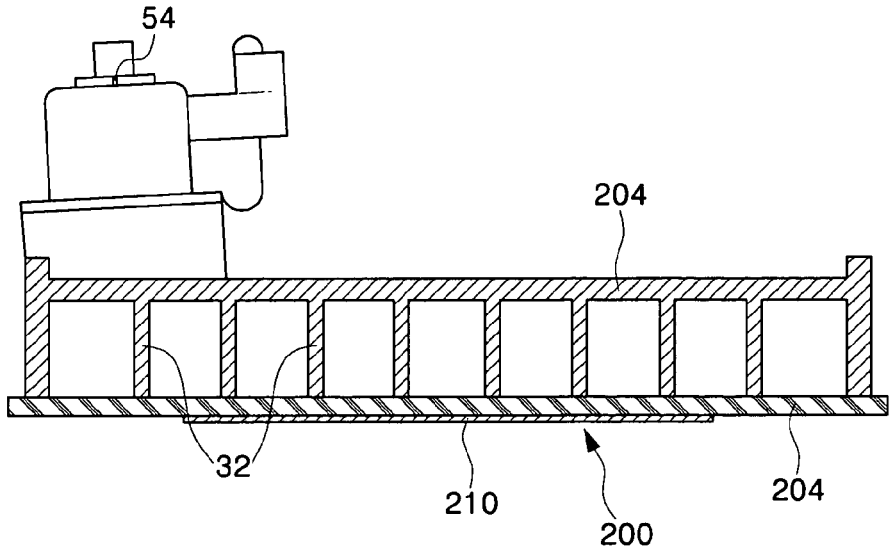
FIG. 5 is a cross-sectional view taken along line C-C' in FIG. 2.
Figure 6:
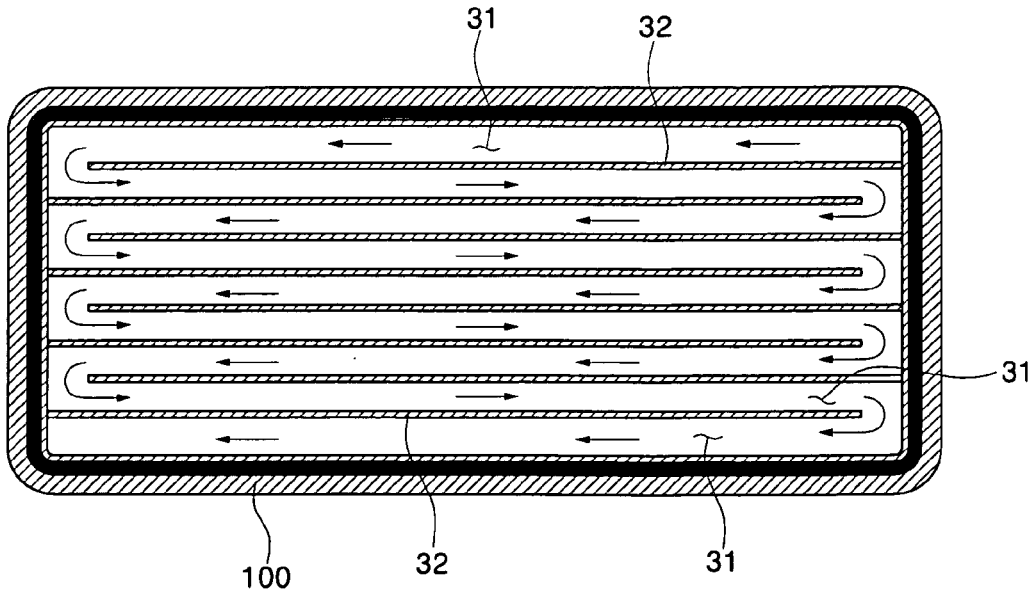
FIG. 6 is a cross-sectional plan view of the instant water heating apparatus for a cleaning machine in accordance with the exemplary embodiment of the present invention.
Figure 7:
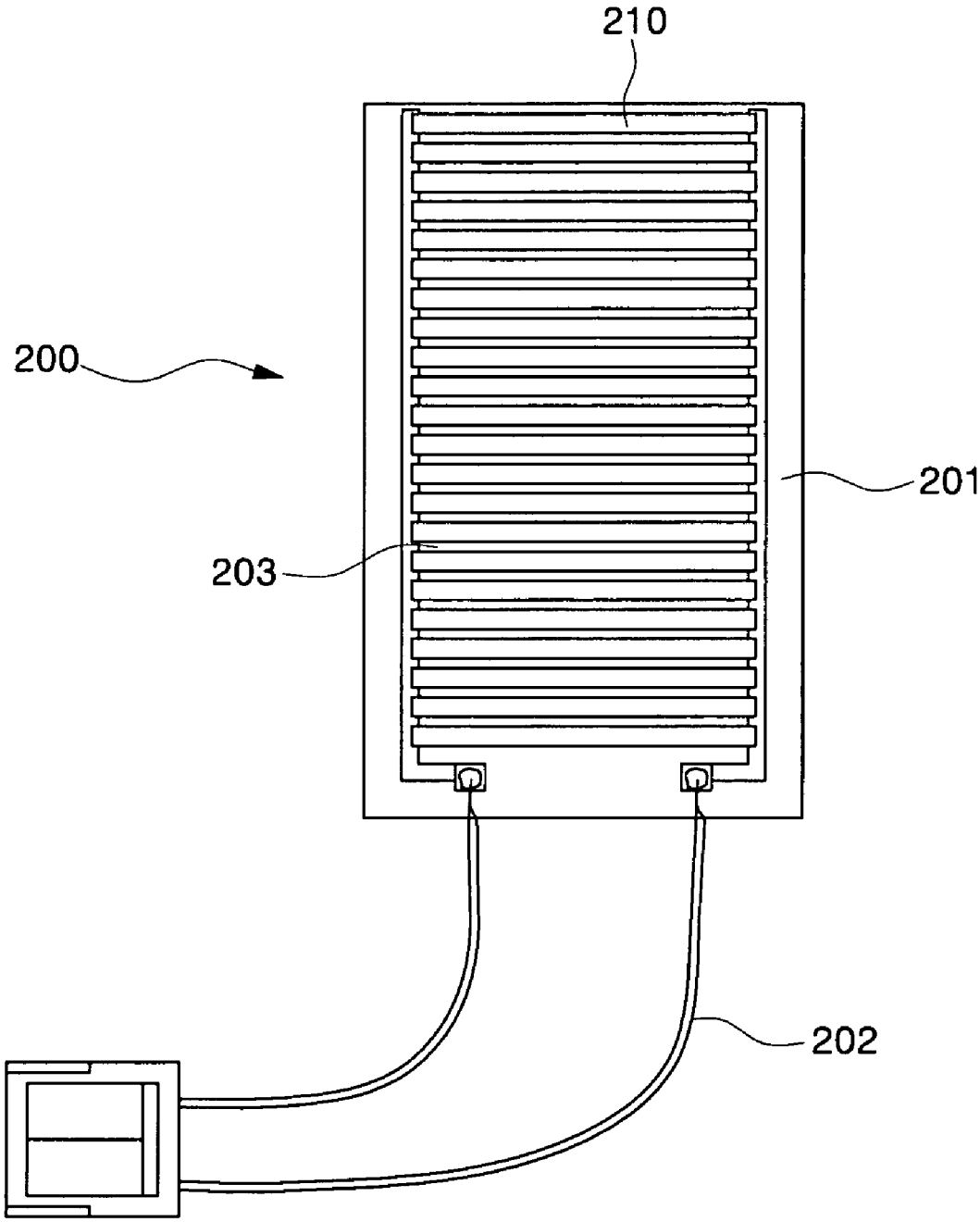
FIG. 7 shows the structure of a heater in accordance with an exemplary embodiment of the present invention.
Figure 8:
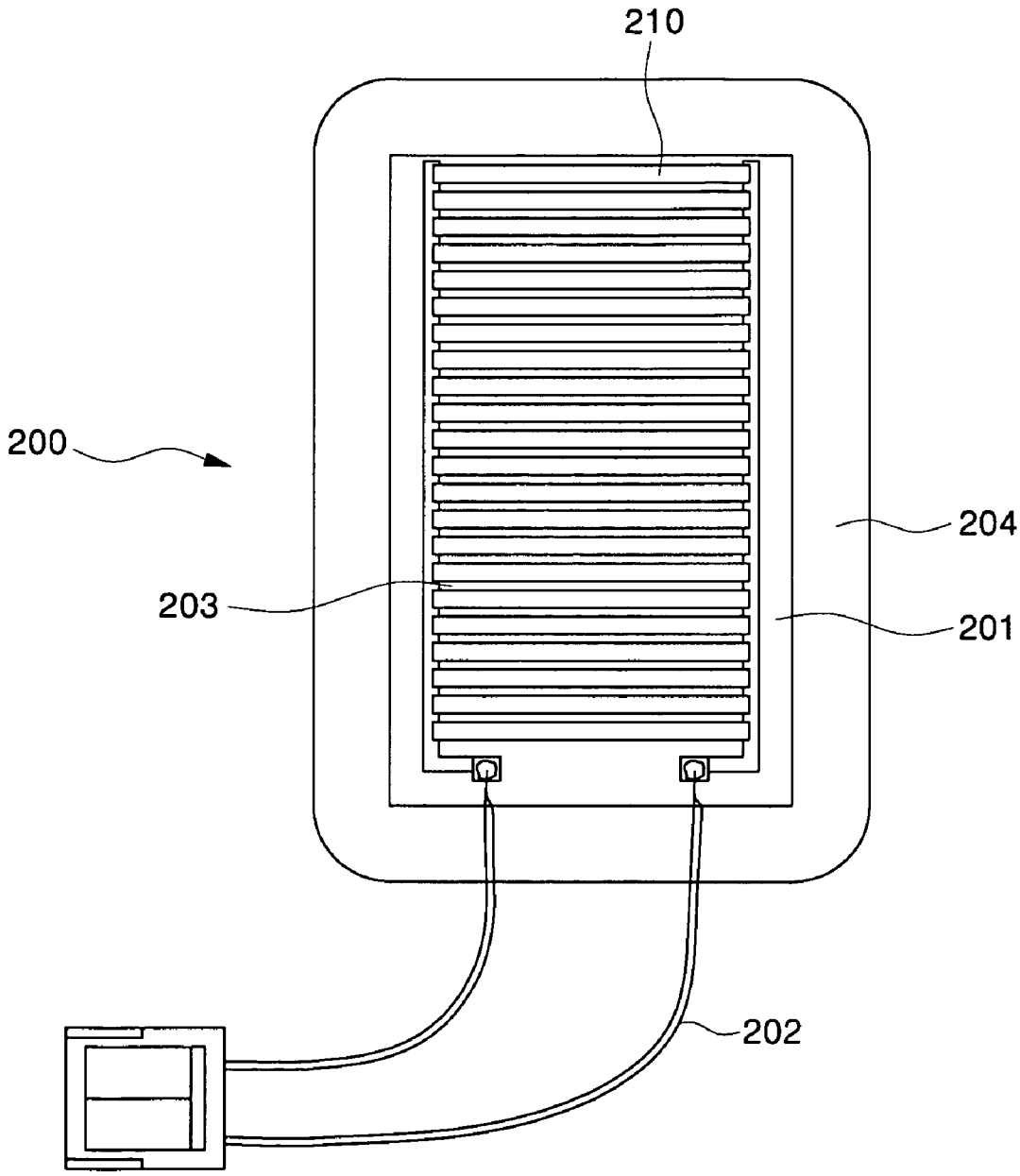
FIG. 8 shows the state of a heater indirectly connected to a heat exchange part through a mounting plate in accordance with an exemplary embodiment of the present invention.

FIG. 1 is an exploded perspective view of an instant water heating apparatus for a cleaning machine in accordance with an exemplary embodiment of the present invention, FIG. 2 is a plan view of the instant water heating apparatus for a cleaning machine in accordance with the exemplary embodiment of the present invention, FIG. 3 is a cross-sectional view taken along line A-A' in FIG. 2, FIG. 4 is a cross-sectional view taken along line B-B' in FIG. 2, FIG. 5 is a cross-sectional view taken along line C-C' in FIG. 2, FIG. 6 is a plan cross-sectional view of the instant water heating apparatus for a cleaning machine in accordance with the exemplary embodiment of the present invention, FIG. 7 shows the structure of a heater in accordance with an exemplary embodiment of the present invention, and FIG. 8 shows the state of a heater indirectly connected to a heat exchange part through a mounting plate in accordance with an exemplary embodiment of the present invention.

Referring to FIG. 1, the instant water heating apparatus for a cleaning machine in accordance with the present invention includes a housing 100 and a heater 200. The heater 200 having a plate shape is securely fastened to the housing 100. In addition, a packing member or a gasket (not shown) may be disposed between the housing 100 and the heater 200 to hermetically seal the interior defined therebetween.

Referring to FIGS. 1 to 4, the housing 100 includes a water inlet port 10, a water outlet port 20, and a heat exchange part 30 having a predetermined space disposed between the water inlet port 10 and the water outlet port 20 to exchange heat with the heater 200.

Referring to FIGS. 3 and 7, the heater 200 having a plate shape includes a plurality of heat generating bodies 210, a heat transfer member 201, lead wires 202, and a conductor 203.

The heat generating bodies 210 are formed of a ruthenium-based material for generating heat when current is supplied through the lead wires 202, which are plasticized at a high temperature to be printed on one surface of the heat transfer member 201 at predetermined intervals.

The heat transfer member 201 may be directly attached to an outer surface of the heat exchange part 30, or as shown in FIG. 8, may be printed on one surface of a mounting plate 204 to be indirectly attached to the outer surface of the heat exchange part 30. Preferably, the heat transfer member 201 may be directly attached to the outer surface of the heat exchange part 30.

In addition, the heat transfer member 201 may be disposed in a flow path 31 in the housing 100. In this case, in order to protect the heat generating bodies 210 and the lead wires 202 from fluid, the heat transfer member 201 has an insulating layer (not shown) applied on its surface.

At this time, the heat transfer member 201 is a plate member formed of aluminum oxide or stainless steel, but not limited thereto, may be formed of various materials such as ceramic or copper having a high thermal conductivity.

In addition, the heater 200 may include a radiation plate (not shown) for exchanging heat so that the heat generating bodies 210 increase heat exchange efficiency with fluid.

The lead wires 202 are connected to the heat generating bodies to supply current to the heat generating bodies, and the conductor 203 connects both ends of each of the heat generating bodies 210 so that current can be simultaneously supplied to the heat generating bodies 210 through the lead wires 202.

Referring to FIG. 3, the heat exchange part 30 is defined by the housing 100 having a uniform thickness so that the introduced fluid is instantly heat-exchanged, and the heater 200 having a plate shape is attached to a lower part of the housing 100.

In addition, as shown in FIG. 6, the heat exchange part 30 has a zigzag flow path 31 to increase a heat exchange contact area so that the introduced fluid can be sufficiently heat-exchanged. At this time, the zigzag flow path 31 may be configured by forming a partition wall 32 having a through-hole at one side of the heat exchange part 30.

As shown in FIG. 3, the housing 100 includes a mixing part 40 having a predetermined space, in which the laminar fluid divided into a cold water region and a hot water region heated in the heat exchange part 30 is uniformly mixed. In addition, the mixing part 40 includes an introduction hole 41 through which the fluid heated in the heat exchange part 30 can be introduced.

Here, the introduction hole 41 has a diameter larger than that of the water outlet port 20. This reason for this is that more fluid is introduced through the introduction hole 41 than is supplied to a cleaning machine (not shown) through the water outlet port 20, and thus a certain pressure is formed at the mixing part 40. At the same time, flow of the fluid is accumulated to make the speed of the running fluid slow, thereby increasing mixing efficiency of the fluid in the mixing part 40.

In order to appropriately mix the heat-exchanged fluid, the introduction hole 41 may be formed at one side of the mixing part 40 to generate eddies. That is, the introduction hole 41 and the water outlet port 20 may be deliberately misaligned with each other.

In addition, the mixing part 40 has a predetermined space to accommodate a certain amount of heat-exchanged fluid therein. Further, the mixing part 40 has an area smaller than that of the heat exchange part 30. Therefore, the fluid appropriately mixed in the mixing part 40 and having a uniform temperature is supplied into a hot water cleaning machine (not shown) through the water outlet port 20.

The instant water heating apparatus for a cleaning machine in accordance with the present invention includes a plurality of detection parts 50. The detection parts 50 installed at different positions will be described with reference to FIGS. 3 to 5.

As shown in FIG. 4, the water inlet port 10 has a water inlet sensor 51 for measuring the temperature of the introduced fluid to adjust a calorific value of the heater 200 until the temperature of the fluid arrives at a set temperature. That is, as a result of measuring the temperature using the water inlet sensor 51, when the temperature is too low, the calorific value of the heater 200 is increased, and when too high, the calorific value of the heater 200 is lowered.

At this time, the water inlet sensor 51 is disposed adjacent to the water inlet port 10 to detect the temperature of the fluid entered through the water inlet port 10. In order to prevent the countercurrent of the heat-exchanged fluid, which may exert a bad influence on the water inlet sensor 51, the water inlet port 10 is spaced apart from the heat exchange part 30 by a predetermined distance.

In addition, as shown in FIG. 3, a fuse 52 is electrically connected to the heater 200 for preventing the heater 200 from being overheated.

That is, the fuse 52 is connected to the lead wires 202. Therefore, when the heat generating bodies 210 are rapidly overheated and the overheating is detected, electric power supplied to the heat generating bodies 210 is cut off.

As shown in FIG. 4, a bimetal 53 is electrically connected to the heater 200.

That is, the bimetal 53 is installed adjacent to the water outlet port 20 of the heat exchange part 30, and at the same time, directly connected to the heat generating bodies 201.

Therefore, as a result of detecting the temperature of the fluid sufficiently heated in the heat exchange part 30 before entering the mixing part 40, when the temperature is higher than a temperature rating of the bimetal 53, the current supply to the heat generating bodies 210 is cut off, and when lower than the temperature rating, the current is supplied.

Therefore, the bimetal 54 maintains a certain temperature, and the fuse 52 prevents overheating.

Here, while safety devices such as the fuse 52 and bimetal 53 may be fastened using a separate member by screws, in order to more simply and stably attach the fuse 52 and bimetal 53, a high temperature silicon-based adhesive agent (not shown) having a high thermal conductivity may be used to obtain properties such as insulation, thermal conductivity, attach ability, and so on.

As shown in FIG. 3, the mixing part 40 is provided with a water level sensor 54 for measuring the level of the fluid contained in the mixing part 40. A water outlet sensor 55 is installed at the water outlet port 20 of the mixing part 40 to detect the temperature of the uniformly mixed fluid. That is, the temperature of the uniformly mixed fluid supplied through the water outlet port 20 can be precisely detected.

In this process, the temperatures detected by the water outlet sensor 55 and the water inlet sensor 51 are compared to obtain a correction value. Therefore, it is possible to correct a calorific value of the heater 200 on the basis of the correction value.

That is, after measuring the temperature at the water inlet sensor 51 and adjusting the calorific value of the heater 200 to heat the fluid, the water outlet sensor 55 detects the temperature of the heated fluid to obtain a correction value between a target temperature and the temperature of the heated fluid. Therefore, when the temperature detected by the water outlet sensor 55 is higher than the target temperature, the calorific value of the heater 200 is lowered by the correction value, and when lower than the target temperature, the calorific value of the heater 200 is increased by the correction value.

In other words, on the basis of information detected by the water inlet sensor 51 and the water outlet sensor 55, the water outlet sensor 55 determines whether the fluid is discharged at an appropriate temperature. Then, the correction value is calculated on the basis of the determination to adjust the calorific value of the heater 200, under control of a program for adjusting the calorific value.

Hereinafter, operation of the instant water heating apparatus for a cleaning machine in accordance with the present invention will be described with reference to FIGS. 1 to 8.

The instant water heating apparatus is controlled by a microcomputer. Therefore, when a user pushes a cleaning button of the cleaning machine, a water entering apparatus (for example, a booster pump, a pressure reducing valve, a check valve, a water stopper, and so on) operates to introduce the fluid into the water inlet port 10.

Then, the water inlet port 51 detects the temperature of the fluid introduced into the water inlet port 10, and then power is supplied to the heat generating bodies 210 in the heater 200 through the lead wires 202. At this time, a microcomputer (not shown) adjusts the calorific value of the heat generating bodies 210 on the basis of the detected temperature.

Next, the fluid passes through the zigzag flow path 31 of the heat exchange part 30 shown in FIG. 6 to sufficiently exchange heat with the heat generating bodies 210 of the heater 200. Then, as shown in FIG. 3, the heat-exchanged fluid is introduced into the mixing part 40 in a laminar flow which is divided into a hot water region in contact with the heater 200 and a cold water region not in contact with the heater 200.

Then, the fluid entered the mixing part 40 generates eddies in a predetermined space to sufficiently mix the laminar fluid, thereby forming a uniform temperature of fluid.

Next, the uniformly mixed fluid is supplied into the cleaning machine (not shown) through the water outlet port 20. The temperature of the uniformly mixed fluid is detected at the water outlet port 20 by the water outlet sensor 55.

At this time, since the fluid is sufficiently mixed, the fluid has a uniform temperature, regardless of detection positions, and the temperature can be precisely detected.

Then, the water outlet sensor 55 calculates a difference between the detected temperature and a target temperature to obtain a correction value. Next, program for correcting the calorific value of the heat generating bodies 210 in the heater 200 is executed according to the calculated correction value so that the fluid can be discharged through the water outlet port 20 at a desired temperature.

At this time, when the temperature is higher than a set temperature, the current supplied to the heat generating bodies 210 through the lead wires 202 is cut off by the bimetal 53, and when lower than the set temperature, the current is supplied again.

In addition, when the heat generating bodies 210 of the heater 200 are overheated, the fuse 52 cuts off the current supplied to the heat generating bodies 210 through the leas wires 202 to prevent a safety accident.

While the instant water heating apparatus in accordance with the present invention is installed at a hot water cleaning machine to instantaneously provide hot water, the instant water heating apparatus may be applied to various apparatus such as a water purifier, a automatic vending machine, and so on, which requires hot water.

As can be seem from the foregoing, a heat exchange part of an instant water heating apparatus for a cleaning machine in accordance with the present invention has a zigzag heating path and a heater having a plate shape installed on the heating path to instantaneously heat the flowing fluid.

In addition, the fluid supplied in a lamina flow which is divided into a hot water region and a cold water region is uniformly mixed, thereby supplying a uniform temperature of fluid.

Although the instant water heating apparatus for a cleaning machine of the present invention has been shown and described, it will be appreciated by those skilled in the art that changes may be made in these embodiments without departing from the principles and spirit of the invention, the scope of which is defined in the appended claims and their equivalents.

What is claimed is:

1. An instant water heating apparatus for a cleaning machine comprising:

a housing having a water inlet port, a water outlet port, and a flow path formed between the water inlet port and the water outlet port;

a heat exchange part having a heating part for exchanging heat with fluid supplied through the water inlet port and guiding the fluid to the water outlet port; and a mixing part having an introduction port for uniformly mixing fluid of a warm water layer and a cold water layer, when the fluid heat-exchanged in the heat exchange part is guided to the water outlet port in a laminar flow in which temperatures of the fluid are divided as the warm water layer in contact with a heater and the cold water layer not in contact with the heater, wherein the introduction port has a diameter larger than that of the water outlet port so that the mixing part generates countercurrent to sufficiently mix the heat-exchanged fluid.

2. The instant water heating apparatus according to claim 1, wherein the flow path has a zigzag shape formed by partition walls having a through-hole at one side.

3. The instant water heating apparatus according to claim 1, wherein the heating part is a plate heater disposed on a flow path to instantly exchange heat with the fluid entered the water inlet port.

4. The instant water heating apparatus according to claim 3, wherein the plate heater comprises:

a plurality of heat generating bodies formed of a ruthenium-based material for generating heat when current is supplied;

a heat transfer member on which the heat generating bodies are formed;

lead wires for supplying current to the heat generating bodies; and a conductor for connecting both ends of the heat generating bodies so that the current is simultaneously supplied through the lead wires.

5. The instant water heating apparatus according to claim 4, wherein the heat generating bodies are attached to one surface of the heat transfer member through printing.

6. The instant water heating apparatus according to claim 4, wherein the heat transfer member is formed of a ceramic member.

7. The instant water heating apparatus according to claim 4, wherein the heat transfer member is formed of a stainless steel member.

8. The instant water heating apparatus according to claim 4, wherein the heat transfer member is disposed on an inner surface of the flow path.

9. The instant water heating apparatus according to claim 8, wherein the heat transfer member has the plurality of heat generating bodies attached to one surface thereof through printing, the heat generating bodies are connected to the lead wires, and the heat transfer member in which the heat generating bodies and the lead wires are formed are insulated using an insulating material.

10. The instant water heating apparatus according to claim 4, wherein the heat transfer member is disposed on an outer surface of the flow path.

11. The instant water heating apparatus according to claim 4, wherein the heat transfer member is attached to one surface of a mounting plate through printing, and the other surface of the mounting plate is attached to an outer surface of the flow path of the heat exchange part.

12. The instant water heating apparatus according to claim 3, wherein the plate heater is electrically connected to a fuse to prevent the heater from being overheated.

13. The instant water heating apparatus according to claim 12, wherein the plate heater comprises the heat generating bodies and lead wires, and the fuse is electrically connected to the lead wires for supplying current to the heat generating bodies.

14. The instant water heating apparatus according to claim 3, wherein the plate heater is electrically connected to a bimetal for uniformly controlling the temperature of the heat-exchanged fluid.

15. The instant water heating apparatus according to claim 14, wherein the bimetal is installed at the water outlet port of the housing.

16. The instant water heating apparatus according to claim 14, wherein the plate heater comprises the heat generating bodies, and the bimetal is connected to the heat generating bodies.

17. The instant water heating apparatus according to claim 1, wherein the mixing part comprises a water level sensor for detecting the level of the heat-exchanged fluid, and a water outlet sensor for detecting the temperature of the mixed fluid.

18. The instant water heating apparatus according to claim 17, wherein the water outlet sensor is disposed adjacent to the water outlet port.

19. The instant water heating apparatus according to claim 17, wherein the water outlet sensor is configured to calculate the temperature detected by the water inlet sensor to obtain a temperature correction value of the fluid, and to correct a calorific value of the heater using the temperature correction value.

20. The instant water heating apparatus according to claim 1, wherein the introduction port is alternately disposed opposite to the water outlet port to increase mixing efficiency in the mixing part.

21. The instant water heating apparatus according to claim 1, wherein the housing comprises a water inlet sensor for detecting the temperature of the fluid entered through the water inlet port to adjust a calorific value of the heater.

22. The instant water heating apparatus according to claim 21, wherein the water inlet sensor is installed at the water inlet port.

23. The instant water heating apparatus according to claim 1, wherein the mixing part is disposed in the housing, and between the water outlet port and the heat exchange part.

* * * * *